US008410999B2

(12) United States Patent
Kang et al.

(10) Patent No.: US 8,410,999 B2
(45) Date of Patent: Apr. 2, 2013

(54) ORGANIC LIGHT EMITTING DISPLAY AND METHOD OF DRIVING THE SAME

(75) Inventors: Chul-Kyu Kang, Yongin (KR); Yong-Sung Park, Yongin (KR)

(73) Assignee: Samsung Display Co., Ltd., Yongin-si (KR)

( * ) Notice: Subject to any disclaimer, the term of this patent is extended or adjusted under 35 U.S.C. 154(b) by 190 days.

(21) Appl. No.: 12/975,522

(22) Filed: Dec. 22, 2010

(65) Prior Publication Data

US 2012/0038682 A1 Feb. 16, 2012

(30) Foreign Application Priority Data

Aug. 10, 2010 (KR) ..... 10-2010-0076851

(51) Int. Cl.
*G09G 3/30* (2006.01)

(52) U.S. Cl. ..... 345/77; 345/204

(58) Field of Classification Search ..... 345/76–83, 345/48, 44, 204–211; 315/169.3
See application file for complete search history.

(56) References Cited

U.S. PATENT DOCUMENTS

2008/0048949 A1* 2/2008 Kim ..... 345/80
2008/0055299 A1* 3/2008 Choi et al. ..... 345/211
2008/0150846 A1* 6/2008 Chung ..... 345/80
2008/0224965 A1* 9/2008 Kim ..... 345/76
2009/0243979 A1 10/2009 Kim
2009/0309816 A1* 12/2009 Choi ..... 345/76
2010/0141564 A1 6/2010 Choi et al.
2010/0201675 A1* 8/2010 Kuranaga et al. ..... 345/211

FOREIGN PATENT DOCUMENTS

KR 10-0907391 7/2009
KR 10-2010-0064620 6/2010

* cited by examiner

*Primary Examiner* — Hong Zhou
(74) *Attorney, Agent, or Firm* — Christie, Parker & Hale, LLP

(57) ABSTRACT

An organic light emitting display includes pixels coupled to scan lines, first control lines, second control lines, data lines, and first and second power sources. The organic light emitting display further includes a control line driver for providing a first control signal and a second control signal to the pixels through the first control lines and the second control lines, a scan driver for providing scan signals to the pixels through the scan lines, and a data driver for providing data signals to the pixels through data lines. The control line driver simultaneously supplies a first off control signal to the pixels through the first control lines in a first period, simultaneously supplies a reference voltage to the pixels through the first control lines in a second period, and simultaneously supplies a first on control signal to the pixels through the first control lines in a third period.

11 Claims, 2 Drawing Sheets

ORGANIC LIGHT EMITTING DISPLAY AND METHOD OF DRIVING THE SAME

CROSS-REFERENCE TO RELATED APPLICATION

This application claims priority to and the benefit of Korean Patent Application No. 10-2010-0076851, filed on Aug. 10, 2010, in the Korean Intellectual Property Office, the entire disclosure of which is incorporated herein by reference.

BACKGROUND

1. Field

Aspects of the present invention relate to an organic light emitting display and a method of driving the same, and more particularly, to an organic light emitting display capable of compensating for deviation in a threshold voltage without a voltage swing and a method of driving the same.

2. Description of the Related Art

Recently, flat panel displays (FPD) having reduced weight and volume as compared to cathode ray tubes (CRT) have been developed. The FPDs include liquid crystal displays (LCD), field emission displays (FED), plasma display panels (PDP), and organic light emitting displays.

Among the FPDs, the organic light emitting displays display images using organic light emitting diodes (OLED) which generate light by the re-combination of electrons and holes. The organic light emitting displays have high response speed and are driven with low power consumption. In general, the OLED is divided into a passive matrix type OLED (PMOLED) and an active matrix type OLED (AMOLED) according to a method of driving the OLED.

The AMOLED includes a plurality of gate lines, a plurality of data lines, a plurality of power source lines, and a plurality of pixels coupled to the above lines to be arranged in the form of a matrix. In addition, each of the pixels commonly includes an OLED, two transistors, (i.e., a switching transistor for transmitting a data signal and a driving transistor for driving the organic light emitting diode (OLED) in accordance with the data signal), and a capacitor for maintaining the data voltage.

However, the conventional organic light emitting display may not display an image with uniform brightness due to a deviation in a threshold voltage. In detail, the threshold voltages of driving transistors included in pixels, are different from each other due to deviations in the manufacturing process. Therefore, although the data signal corresponding to the same gray scale is supplied to the plurality of pixels, since light components of the plurality of pixels generate different brightness components due to a difference in the threshold voltage of the driving transistor, brightness becomes non-uniform.

SUMMARY

Accordingly, an aspect of the present invention provides an organic light emitting display capable of compensating for deviation in the threshold voltages of the driving transistors included in pixels without a power swing in order to display an image with uniform brightness and a method of driving the same.

According to another aspect of the present invention, there is provided an organic light emitting display, including a pixel unit including pixels coupled to scan lines, first control lines, second control lines, data lines, and first and second power sources, a control line driver for providing a first control signal and a second control signal to the pixels through the first control lines and the second control lines, a scan driver for providing scan signals to the pixels through the scan lines, and a data driver for providing data signals to the pixels through the data lines. The control line driver simultaneously supplies a first off control signal to the pixels through the first control lines in a first period of one frame period, simultaneously supplies a reference voltage to the pixels through the first control lines in a second period of one frame period, and simultaneously supplies a first on control signal to the pixels through the first control lines in a third period of one frame period.

According to another aspect of the present invention, the reference voltage is set as a voltage value between a voltage value of the first off control signal and a voltage value of the first on control signal.

According to another aspect of the present invention, the scan driver simultaneously supplies a first scan signal to the pixels through the scan lines in the first period.

According to another aspect of the present invention, the scan driver sequentially supplies a second scan signal to the scan lines in the second period.

According to another aspect of the present invention, the control line driver simultaneously supplies a second on control signal to the pixels through the second control lines in the first period, simultaneously supplies a second off control signal to the pixels through the second control lines in the second period, and simultaneously supplies a second on control signal to the pixels through the second control lines in the third period.

According to another aspect of the present invention, the data driver simultaneously supplies an initializing signal to the pixels through the data lines in the first period.

According to another aspect of the present invention, each of the pixels includes a first transistor having a first electrode coupled to the first power source, having a second electrode coupled to a first electrode of a third transistor, and having a gate electrode coupled to a first electrode of a second transistor, a second transistor having a first electrode coupled to a gate electrode of the first transistor, having a second electrode coupled to a data line, and having a gate electrode coupled to a scan line, a third transistor having a first electrode coupled to a second electrode of the first transistor, having a second electrode coupled to a first electrode of a fourth transistor, and having a gate electrode coupled to a first control line, a fourth transistor having a first electrode coupled to a second electrode of the third transistor, having a second electrode coupled to an organic light emitting diode (OLED), and having a gate electrode coupled to a second control line, a storage capacitor coupled between the gate electrode of the first transistor and the second electrode of the third transistor, and an OLED coupled between the second electrode of the fourth transistor and the second power source.

According to another aspect of the present invention, the first to fourth transistors are either PMOS transistors or NMOS transistors.

According to another aspect of the present invention, there is provided a method of driving an organic light emitting display, including simultaneously supplying a first scan signal, a first off control signal, and a second on control signal to pixels that constitute a pixel unit so that a voltage corresponding to a difference between an initializing signal and an anode electrode voltage of an organic light emitting diode is charged in a storage capacitor of each of the pixels, sequentially supplying a second scan signal to the pixels and applying data signals to the pixels, to which a second scan signal is supplied, so that voltages corresponding to the data signals are charged in storage capacitors of the pixels, and simultaneously supplying a first on control signal and a second on control signal to the pixels so that the pixels simultaneously emit light with brightness components corresponding to the voltages charged in the storage capacitors of the pixels.

According to another aspect of the present invention, in writing down data to the pixels, a reference voltage and a second off control signal are supplied to the pixels so that a voltage obtained by subtracting a threshold voltage of a third transistor from a data signal and a reference voltage is charged in the storage capacitors of the pixels.

According to another aspect of the present invention, the reference voltage is set as a voltage value between the voltage value of the first off control signal and the voltage value of the first on control signal.

As described above, according to an aspect of the present invention, deviation in the threshold voltages of the driving transistors included in the pixels may be compensated without power swing so as to provide an organic light emitting display that displays an image with uniform brightness and the method of driving the same.

Additional aspects and/or advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION

Figure 1:
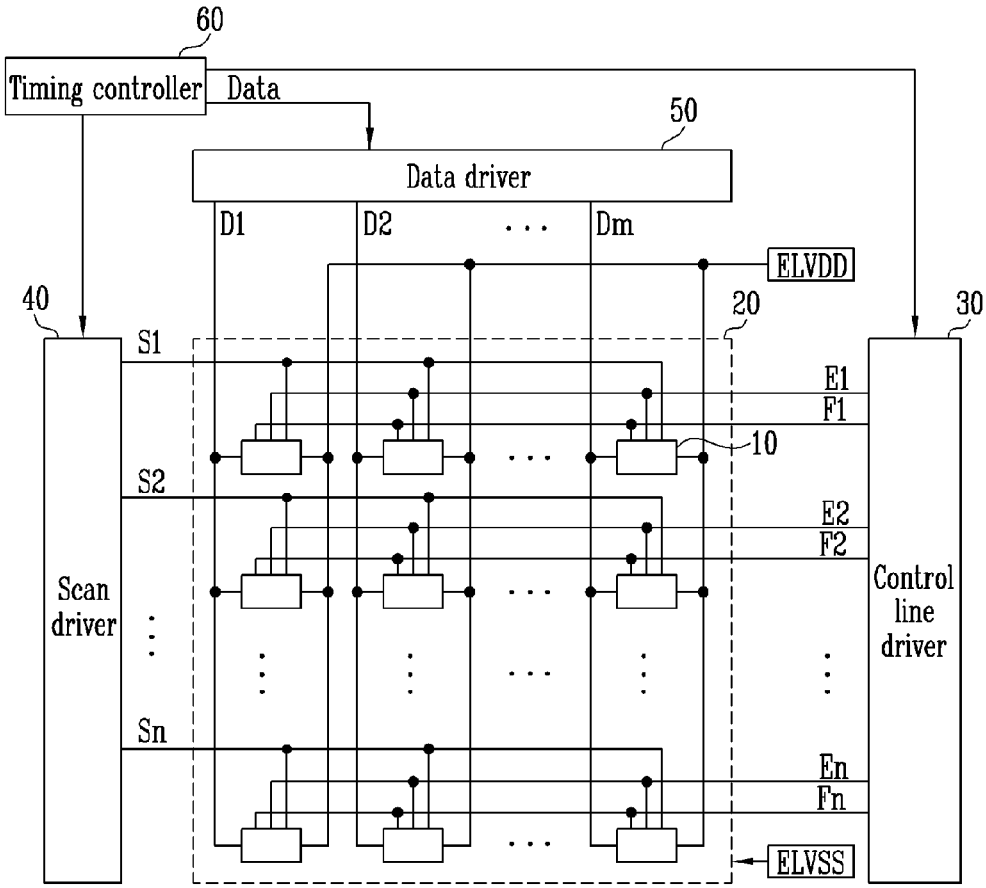
FIG. 1 is a view illustrating an organic light emitting display according to an embodiment of the present invention.

Reference will now be made in detail to the present embodiments of the present invention, examples of which are illustrated in the accompanying drawings, wherein like reference numerals refer to the like elements throughout. The embodiments are described below in order to explain the present invention by referring to the figures.

Here, when a first element is described as being coupled to a second element, the first element may be not only directly coupled to the second element but may also be indirectly coupled to the second element via a third element.

Hereinafter, the aspects of the present invention will be described with reference to drawings for describing an organic light emitting display and a method of driving the same according to the embodiments of the present invention.

FIG. 1 is a view illustrating an organic light emitting display according to an embodiment of the present invention. Referring to FIG. 1, the organic light emitting display includes a pixel unit 20 having pixels 10 coupled to scan lines S1 to Sn, first control lines E1 to En, second control lines F1 to Fn, data lines D1 to Dm, a first power source ELVDD, a second power source ELVSS. The organic light emitting display further includes a control line driver 30, a scan driver 40, and a data driver 50. The control line driver 30 supplies a first control signal and a second control signal to the pixels 10 through the first control lines E1 to En and the second control lines F1 to Fn. The scan driver 40 supplies scan signals to the pixels 10 through the scan lines S1 to Sn. The data driver 50 supplies data signals to the pixels 10 through data lines D1 to Dm. While not required in all aspects, the shown organic light emitting display may further include a timing controller 60 for controlling the control line driver 30, the scan driver 40, and the data driver 50.

The pixels 10 are coupled to the first power source ELVDD and the second power source ELVSS. The pixels 10 that are coupled to the first power source ELVDD and the second power source ELVSS generate light corresponding to the data signals according to the current that flows from the first power source ELVDD to the second power source ELVSS via an organic light emitting diode (OLED).

The timing controller 60 controls the control line driver 30 to generate the first control signal and the second control signal, and the control line driver 30 supplies the generated first control signal to the first control lines E1 to En, and supplies the generated second control signal to the second control lines F1 to Fn.

A first off control signal for turning off a transistor and a first on control signal for turning on the transistor are provided in the first control signal supplied by the control line driver 30. In addition, the control line driver 30 may simultaneously supply a reference voltage VREF having a voltage value between the voltage value of the first off control signal and the voltage value of the first on control signal to the first control lines E1 to En.

In addition, a second off control signal for turning off a transistor and a second on control signal for turning on the transistor are included in the second control signal supplied by the control line driver 30. In particular, the control line driver 30 simultaneously supplies the first off control signal to the pixels 10 included in the pixel unit 20 through the first control lines E1 to En in a first period of a one frame period, simultaneously supplies the reference voltage VREF to the pixels 10 through the first control lines E1 to En in the next second period, and simultaneously supplies the first on control signal to the pixels 10 through the first control lines E1 to En in a third period.

In addition, the control line driver 30 simultaneously supplies the second on control signal to the pixels 10 through the second control lines F1 to Fn in the first period, simultaneously supplies the second off control signal to the pixels 10 through the second control lines F1 to Fn in the second period, and simultaneously supplies the second on control signal to the pixels 10 through the second control lines F1 to Fn in the third period.

In FIG. 1, the control line driver 30 is separate from the scan driver 40, however, the control line driver 30 may be included in the scan driver 40. The scan driver 40 generates the scan signals by the control of the timing controller 60 and simultaneously and sequentially supplies the generated scan signals to the scan lines S1 to Sn. In particular, the scan driver 40 supplies scan signals twice to the scan lines S1 to Sn in one frame. Of the scan signals supplied twice in one frame the scan signal supplied first is defined as a first scan signal and the scan signal supplied second is defined as a second scan signal.

In addition, the first scan signal is simultaneously supplied to the pixels 10 through the scan lines S1 to Sn in the first period. However, the second scan signal is sequentially supplied from the first scan line S1 to the nth scan line Sn to be applied to the pixels 10 in the second period.

The data driver 50 generates the data signals by the control of the timing controller 60 and supplies the generated data signals to the data lines D1 to Dm. In addition, the data driver 50 simultaneously supplies an initializing signal V0 to the data lines D1 to Dm in the first period where the first scan signal is supplied in order to initialize the voltage of the pixels 10 and simultaneously supplies the initializing signal V0 to the pixels 10. In order to write down data, in the second period where the second scan signal is sequentially supplied to the scan lines S1 to Sn, the data signals are supplied to the pixels 10 that receive the second scan signal.

Figure 2:
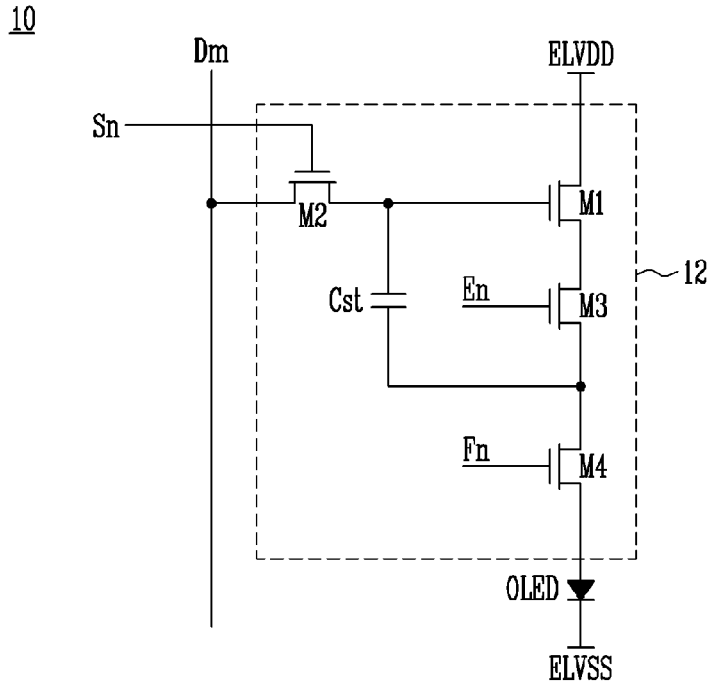
FIG. 2 is a view illustrating a pixel according to an embodiment of the present invention.

FIG. 2 is a view illustrating a pixel 10 according to an exemplary embodiment of the present invention. In FIG. 2, for convenience sake, the pixel 10 coupled to the nth scan line Sn and the mth data line Dm will be illustrated.

Referring to FIG. 2, the pixel 10 includes a pixel circuit 12 coupled to the OLED, the data line Dm, and the scan line Sn to control an amount of current supplied to the OLED. The anode electrode of the OLED is coupled to the pixel circuit 12 and the cathode electrode of the OLED is coupled to the second power source ELVSS. The OLED generates light having a predetermined brightness corresponding to the current supplied from the pixel circuit 12.

The pixel circuit 12 controls the current that flows from the first power source ELVDD to the second power source ELVSS via the OLED to correspond to the data signal supplied to the data line Dm when a scan signal is supplied to the scan line Sn. Therefore, the pixel circuit 12 includes first to fourth transistors M1 to M4 and a storage capacitor Cst. However, aspects of the present invention are not limited thereto and the pixel circuit 12 may include more or less transistors and capacitors.

The first transistor M1 is a driving transistor which generates the current corresponding to a voltage between a gate electrode and a second electrode and supplies the current to the OLED. Therefore, the first electrode of the first transistor M1 is coupled to the first power source ELVDD, the second electrode of the first transistor M1 is coupled to the first electrode of the third transistor M3, and the gate electrode of the first transistor M1 is coupled to the first electrode of the second transistor M2.

The first electrode of the second transistor M2 is coupled to the gate electrode of the first transistor M1, the second electrode of the second transistor M2 is coupled to the data line Dm, and the gate electrode of the second transistor M2 is coupled to the scan line Sn. The second transistor M2 is turned on when the first scan signal or the second scan signal is supplied to the gate electrode of the second transistor M2 from the scan line Sn in order to transmit the initializing signal V0 or the data signal supplied from the data line Dm to the gate electrode of the first transistor M1. The second transistor M2 is turned off when the scan signal is not supplied to the gate electrode of the second transistor M2 thus blocking the initializing signal V0 and the data signal if any from being supplied from the data line Dm to the gate electrode of the first transistor M1.

The scan signal including the first scan signal and the second scan signal turns on the second transistor M2. When the second transistor M2 is an NMOS transistor as illustrated in FIG. 2, a voltage is in a high level. When the second transistor M2 is a PMOS transistor, a voltage is in a low level.

The first electrode of the third transistor M3 is coupled to the second electrode of the first transistor M1, the second electrode of the third transistor M3 is coupled to the first electrode of the fourth transistor M4, and the gate electrode of the third transistor M3 is coupled to the first control line En. The third transistor M3 is turned on when a first on control signal is supplied to the gate electrode of the third transistor M3 from the first control line En in order to electrically couple the second electrode of the first transistor M1 to the first electrode of the fourth transistor M4. The third transistor M3 is turned off when a first off control signal is supplied to the gate electrode of the third transistor M3 in order to block the second electrode of the first transistor M1 from being electrically coupled to the first electrode of the fourth transistor M4.

At this time, the first on control signal turns on the third transistor M3. When the third transistor M3 is an NMOS transistor as illustrated in FIG. 2, a voltage is in a high level. When the third transistor M3 is a PMOS transistor, a voltage is in a low level.

The first off control signal turns off the third transistor M3. When the third transistor M3 is the NMOS transistor as illustrated in FIG. 2, the voltage is in the low level. When the third transistor M3 is the PMOS transistor, the voltage is in the high level so that the phase of the voltage is opposite to the phase of the first on control signal.

The first electrode of the fourth transistor M4 is coupled to the second electrode of the third transistor M3. The second electrode of the fourth transistor M4 is coupled to the anode electrode of the OLED. The gate electrode of the fourth transistor M4 is coupled to the second control line Fn. The fourth transistor M4 is turned on when a second on control signal is supplied to the gate electrode of the fourth transistor M4 from the second control line Fn in order to electrically couple the anode electrode of the OLED to the second electrode of the third transistor M3. The fourth transistor M4 is turned off when a second off control signal is supplied to the gate electrode of the fourth transistor M4 to block the anode electrode of the OLED from being electrically coupled to the second electrode of the third transistor M3.

At this time, the second on control signal turns on the fourth transistor M4. When the fourth transistor M4 is an NMOS transistor as illustrated in FIG. 2, a voltage is in a high level. When the fourth transistor M4 is a PMOS transistor, a voltage is in a low level.

The second off control signal turns off the fourth transistor M4. When the fourth transistor M4 is the NMOS transistor as illustrated in FIG. 2, the voltage is in the low level. When the fourth transistor M4 is the PMOS transistor, the voltage is in the high level so that the phase of the voltage is opposite to the phase of the second on control signal.

One terminal of the storage capacitor Cst is coupled to the gate electrode of the first transistor M1. The other terminal of the storage capacitor Cst is coupled to the second electrode of the third transistor M3.

The anode electrode of the OLED is coupled to the second electrode of the fourth transistor M4 and the cathode electrode of the OLED is coupled to the second power source ELVSS to generate the light corresponding to the driving current generated by the first transistor M1.

The first power source ELVDD, as a high potential power source, is coupled to the first electrode of the first transistor M1. The second power source ELVSS, as a low potential power source having a voltage in a lower level than the first power source ELVDD, is coupled to the cathode electrode of the OLED.

The above-described first to fourth transistors M1 to M4 may be NMOS transistors as illustrated in FIG. 2 and may be PMOS transistors. In addition, the transistors M1 to M4 are oxide thin film transistors having a high short range uniformity (SRU) characteristic, although the invention is not specifically so limited.

Figure 3:
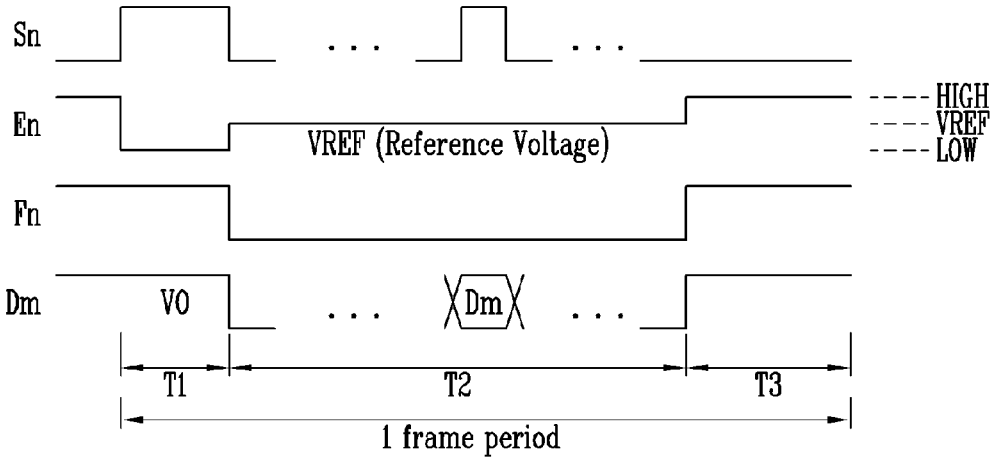
FIG. 3 is a waveform chart illustrating a method of driving the pixel of FIG. 2.

FIG. 3 is a waveform chart illustrating a method of driving the pixel 10 of FIG. 2. The operation of the organic light emitting display according to a driving method of an aspect of the present invention will be described with reference to FIGS. 2 and 3.

Driving of the pixel 10 according to an aspect of the present invention includes of an initializing period T1 for initializing the voltage of the storage capacitor Cst of each of the pixels 10, a data writing period T2 in which data signals are supplied so that the voltages corresponding to the data signals are charged in the storage capacitors Cst of the pixels 10, and an emission period T3 in which the pixels simultaneously emit light with a brightness corresponding to the voltages charged in the storage capacitors Cst of the pixels 10 in each frame period.

First, when the initializing period T1 that is the first period of one frame period is described, a first scan signal is supplied to the scan line Sn in the initializing period t1, the first off control signal is supplied to the first control line En, and the second on control signal is supplied to the second control line Fn. In addition, the initializing signal V0 is supplied to the data line Dm in the initializing period T1.

The second transistor M2 is turned on by the first scan signal so that the initializing signal V0 supplied from the data line Dm is applied to the gate electrode of the first transistor M1. In addition, the fourth transistor M4 is turned on by the second on control signal so that the anode electrode voltage of the OLED that is in an off state is applied to the first electrode of the fourth transistor M4.

In order to prevent the first power source ELVDD from being applied to the first electrode of the fourth transistor M4, as the first off control signal is supplied, the third transistor M3 is turned off in the initializing period T1. Therefore, since the initializing signal V0 is applied to one terminal of the storage capacitor Cst and the anode electrode voltage of the OLED is applied to the other terminal of the storage capacitor Cst, the voltage corresponding to a difference between the initializing signal V0 and the anode electrode voltage of the OLED is charged in the storage capacitor Cst in the initializing period T1.

In the above, only one pixel 10 was described. However, since the first scan signal, the first off control signal, and the second on control signal are simultaneously supplied to the pixels 10 included in the pixel unit 20 shown in FIG. 1, the storage capacitors Cst of the pixels 10 are charged by the voltage corresponding to the difference between the initializing signal V0 and the anode electrode voltage of the OLED in the initializing period T1.

When the supply of the first scan signal is stopped, the period enters into the data writing period T2 that is the second period in one frame period. In the data writing period T2, a second scan signal is supplied to the scan line Sn and the data signal is supplied to the data line Dm to correspond to the second scan signal.

In addition, the reference voltage VREF is supplied to the first control line En and the second off control signal is supplied to the second control signal Fn in the data writing period T2. The second transistor M2 is turned off as the supply of the first scan signal is stopped and the second transistor M2 is turned on in accordance with the second scan signal in order to apply the data signal supplied to the data line Dm to the gate electrode of the first transistor M1.

At this time, the second off control signal is supplied in order to block the current that flows to the OLED and to smoothly charge the storage capacitor Cst so that the fourth transistor M4 is turned off and so that the OLED does not emit light in the data writing period T2.

Since the reference voltage VREF is supplied to the first control line En, the voltage [VREF−Vth3] obtained by subtracting the threshold voltage Vth3 of the third transistor M3 from the reference voltage VREF is applied to the second electrode of the third transistor M3. Therefore, since the voltage Vdata corresponding to the data signal is applied to one terminal of the storage capacitor Cst and the voltage [VREF−Vth3] is applied to the other terminal of the storage capacitor Cst, the voltage corresponding to a difference between the voltage Vdata corresponding to the data signal and [VREF−Vth3] is charged in the storage capacitor Cst.

That is, the voltage charged in the storage capacitor Cst becomes [Vdata−VREF+Vth3].

In the above, only one pixel 10 was described. However, since the second scan signal is sequentially supplied to the scan lines S1 to Sn shown in FIG. 1, the storage capacitors Cst of the pixels 10 charge the voltage of [Vdata−VREF+Vth3] corresponding to the corresponding data signal.

Then, the first on control signal and the second on control signal are simultaneously supplied to the pixels 10 through the first control line En and the second control line Fn so that the period enters into the emission period T3 that is a third period in one frame period. At this time, in order to block the data signal supplied to the data line Dm, the scan signal is not supplied to the gate electrode of the second transistor M2. Therefore, the second transistor M2 is turned off in the emission period T3.

The third transistor M3 and the fourth transistor M4 are turned on by the first on control signal and the second on control signal so that the second electrode of the first transistor M1 is electrically coupled to the anode electrode of the OLED and that the driving current generated by the first transistor M1 may flow to the OLED.

The driving current I generated by the first transistor M1 may be represented as $I=\beta(Vgs-Vth1)^2$ where β is a constant and Vth1 is the threshold voltage of the first transistor M1. Since Vgs is the voltage stored in the storage capacitor Cst, the driving current I may be obtained by Equation 1.

$$I=(V\text{data}-V\text{REF}+V\text{th}3-V\text{th}1)^2 \qquad \text{Equation 1}$$

Here, since the threshold voltages of the first transistor M1 and the third transistor M3 adjacent to each other are almost the same due to the SRU characteristic of the oxide thin film transistors, Vth3 and Vth1 are offset so that the driving current I may be represented as $I=(Vdata-VREF)^2$.

As a result, the threshold voltage Vth factor is removed from the driving current I so that the pixels 10 are not affected by the threshold voltage Vth and an image with uniform brightness may be displayed. Since the first on control signal and the second on control signal are simultaneously supplied to the pixels 10 included in the pixel unit 20, the above-described driving current I flows to the OLEDs of the pixels 10 and the OLEDs generate light components corresponding to the driving current I so that the pixels 10 simultaneously emit light.

As illustrated in FIG. 3, the initializing signal V0 may be supplied to the data line Dm in the emission period T3. However, since the second transistor M2 is turned off in the emission period T3, the initializing signal V0 may not be supplied in other aspects.

In the emission period T3, as the first scan signal is simultaneously supplied to the pixels 10, the period enters into the initializing period T1 and the above-described data writing period T2 and emission period T3 repeatedly operate.

While the aspects of the present invention have been described in connection with certain exemplary embodiments, it is to be understood that the invention is not limited to the disclosed embodiments, but, on the contrary, is intended to cover various modifications and equivalent arrangements included within the spirit and scope of the appended claims, and equivalents thereof.

What is claimed is:

1. An organic light emitting display, comprising:

a pixel unit including pixels coupled to scan lines, first control lines, second control lines, data lines, and first and second power sources;

a control line driver for providing a first control signal and a second control signal to the pixels through the first control lines and the second control lines;

a scan driver for providing scan signals to the pixels through the scan lines; and a data driver for providing data signals to the pixels through the data lines, wherein the control line driver simultaneously supplies a first off control signal to the pixels through the first control lines in a first period of one frame period, simultaneously supplies a reference voltage to the pixels through the first control lines in a second period of one frame period, and simultaneously supplies a first on control signal to the pixels through the first control lines in a third period of one frame period.

2. The organic light emitting display as claimed in claim 1, wherein the reference voltage is set as a voltage value between a voltage value of the first off control signal and a voltage value of the first on control signal.

3. The organic light emitting display as claimed in claim 1, wherein the scan driver simultaneously supplies a first scan signal to the pixels through the scan lines in the first period.

4. The organic light emitting display as claimed in claim 3, wherein the scan driver sequentially supplies a second scan signal to the scan lines in the second period.

5. The organic light emitting display as claimed in claim 1, wherein the control line driver simultaneously supplies a second on control signal to the pixels through the second control lines in the first period, simultaneously supplies a second off control signal to the pixels through the second control lines in the second period, and simultaneously supplies the second on control signal to the pixels through the second control lines in the third period.

6. The organic light emitting display as claimed in claim 1, wherein the data driver simultaneously supplies an initializing signal to the pixels through the data lines in the first period.

7. The organic light emitting display as claimed in claim 1, wherein each of the pixels comprises:

a first transistor having a first electrode coupled to the first power source, having a second electrode coupled to a first electrode of a third transistor, and having a gate electrode coupled to a first electrode of a second transistor;

the second transistor having a first electrode coupled to the gate electrode of the first transistor, having a second electrode coupled to one of the data lines, and having a gate electrode coupled to one of the scan lines;

the third transistor having a first electrode coupled to the second electrode of the first transistor, having a second electrode coupled to a first electrode of a fourth transistor, and having a gate electrode coupled to one of the first control lines;

the fourth transistor having a first electrode coupled to the second electrode of the third transistor, having a second electrode, and having a gate electrode coupled to one of the second control lines;

a storage capacitor coupled between the gate electrode of the first transistor and the second electrode of the third transistor; and an organic light emitting diode (OLED) coupled between the second electrode of the fourth transistor and the second power source.

8. The organic light emitting display as claimed in claim 7, wherein the first to fourth transistors comprise PMOS transistors and/or NMOS transistors.

9. A method of driving an organic light emitting display, comprising:

simultaneously supplying a first scan signal, a first off control signal, and a second on control signal to pixels that constitute a pixel unit so that a voltage corresponding to a difference between an initializing signal and an anode electrode voltage of an organic light emitting diode (OLED) is charged in a storage capacitor of each of the pixels;

sequentially supplying a second scan signal to the pixels and applying data signals to the pixels, to which a second scan signal is supplied, so that voltages corresponding to the data signals are charged in the storage capacitor of each of the pixels; and simultaneously supplying a first on control signal and the second on control signal to the pixels so that the pixels simultaneously emit light with a brightness corresponding to the voltages charged in the storage capacitor of each of the pixels.

10. The method as claimed in claim 9, wherein, in writing down data to the pixels, a reference voltage and a second off control signal are supplied to the pixels so that a difference between a data signal and a voltage obtained by subtracting a threshold voltage of a third transistor from the reference voltage is charged in the storage capacitor of each of the pixels.

11. The method as claimed in claim 10, wherein the reference voltage is set as a voltage value between a voltage value of the first off control signal and a voltage value of the first on control signal.

* * * * *